US006672390B2

(12) United States Patent
Azancot

(10) Patent No.: US 6,672,390 B2
(45) Date of Patent: Jan. 6, 2004

(54) SYSTEMS AND METHODS FOR CONSTRUCTING SUBSEA PRODUCTION WELLS

(75) Inventor: Peter Azancot, Truro (GB)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/173,130

(22) Filed: Jun. 17, 2002

(65) Prior Publication Data

US 2003/0051879 A1 Mar. 20, 2003

Related U.S. Application Data

(60) Provisional application No. 60/298,804, filed on Jun. 15, 2001.

(51) Int. Cl.[7] ..... E21B 29/12

(52) U.S. Cl. ..... 166/341; 166/345; 166/352; 166/358; 405/224.2

(58) Field of Search ..... 166/341, 345, 166/350, 352, 358, 359, 367; 175/5, 7; 405/224.2, 224

(56) References Cited

U.S. PATENT DOCUMENTS 4,053,023 A * 10/1977 Herd et al. ..... 175/7
5,533,574 A * 7/1996 Gonzalez ..... 166/358
5,819,852 A * 10/1998 Cunningham et al. ..... 166/345
5,842,528 A * 12/1998 Johnson et al. ..... 175/45
6,142,236 A * 11/2000 Brammer et al. ..... 166/358

* cited by examiner

*Primary Examiner*—Robert E. Pezzuto
*Assistant Examiner*—Thomas Beach
(74) *Attorney, Agent, or Firm*—Gilbreth & Associates, P.C.; J. M. (Mark) Gilbreth; Mary A. Gilbreth

(57) ABSTRACT

Systems and methods for time, and labor efficient construction and production of subsea wells include a surface blowout preventer stack, a high pressure riser, and a drill thru Xmas tree. The systems may further comprise a subsea shut off and disconnect device.

6 Claims, 1 Drawing Sheet

SYSTEMS AND METHODS FOR CONSTRUCTING SUBSEA PRODUCTION WELLS

This application claim priority to Provisional Application 60/298,804, filed Jun. 15, 2001.

BACKGROUND OF THE INVENTION

1. Field of the Invention

The present invention relates to systems and methods for constructing wells in marine environments. In another aspect, the present invention relates to systems and methods for constructing marine wells comprising use of a surface blowout preventer stack (SBOP). In even another aspect, the present invention relates to systems and methods for constructing marine wells, wherein the methods and systems comprise use of an SBOP and a drill thru Xmas (Christmas) tree. In still another aspect, the present invention relates to systems and methods for constructing marine wells, wherein the systems and methods comprise use of an SBOP, high pressure risers, a subsea shut off and disconnect device, and a drill thru Xmas tree.

2. Description of the Related Art

Exploration and production of hydrocarbons from subsea reservoirs is an expensive and time-consuming process. The drilling and production processes used to obtain hydrocarbon products from subsea wells often require allocation of expensive assets, such as floating drilling and production facilities located offshore. There are a number of problems associated with deepwater offshore drilling and production that are not found in shallow water or land operations.

Primary among these is the marine environment. Unlike the surface environment, much of the deepwater offshore drilling control equipment is located on the seabed and is not subject to direct control and monitoring—one simply cannot see the equipment without the use of vision equipped remotely operated vehicles (ROVs).

The mechanics of drilling in a marine environment also differ from land operations. Drilling operations utilize a weighted drilling fluid, known as mud which is pumped down the drill string and circulated back to the surface through an annulus between the drill string and the borehole wall. The drilling mud cools the drill bit as it rotates and cuts into the earth formation. The mud also provides a medium for returning the cuttings created by the drill to the earth's surface via the annulus. The weight of the drilling mud in the annulus further operates to control pressure in the borehole and help prevent blowouts. Also, additives in the mud are designed to form a cake on the inside walls of the borehole in order to provide borehole stability and to prevent formation fluids from entering the borehole prior to production operations. It will be appreciated that during land operations, the drilling mud and cuttings may be readily returned to the surface via the borehole annulus. Such is not the case in offshore operations.

Offshore operations require location of a floating drilling unit in waters located generally above the reservoir of interest. The depth of the water may range from several hundred feet to depths greater than a mile. A drill string must travel from the surface of the drilling platform, down to the equipment located on the seabed, and then into the bore of interest prior to actually initiating cutting/drilling operations. Unlike land operations, there is no annulus between the floor of the seabed and the drilling platform at the surface. Accordingly, a drilling riser comprised of generally cylindrical elements is provided for and extends from a wellhead located at the seabed up to the drilling platform located above the surface of the water. The riser operates to protect the drill string during operations and acts as an artificial annulus.

The risers are formed from large diameter (on the order of 21 inches) metal tubular goods/joints linked together. Riser joints may be 75 feet or more in length. Buoyancy elements, also called floats, may be affixed to the external surface of the drilling riser along its length in order to establish essentially neutral buoyancy. It is possible that multiple buoyancy elements may be affixed to a single riser joint. The foam floats may be affixed about the riser by any of a number of ways as will be discussed with reference to preferred embodiments of the present invention. The buoyancy elements are often manufactured from syntactic foam or metal, and are generally 6 to 12 feet in length. The specific foam chemistry and diameter of the float are selected in accordance with the specific environmental conditions to be encountered in operations. Typically, the buoyancy elements are manufactured onshore and shipped to the drilling platform, and are usually installed on the riser prior to riser installation.

As with land drilling operations, subsea drilling operations must provide a means for shutting down the well in emergency situations. Generally, a series of blowout preventers (BOPs) referred to as a BOP stack, are used to control well flow in such instances. The BOP stack typically consists of multiple BOPs connected to each other and to the wellhead, and may include shear ram or annular BOPs. In land operations, the BOP stack is typically just below the rotary table and may be easily monitored and operated in response to a significant well event. However, in conventional subsea drilling systems the BOP stack is located on the seafloor and requires various umbilical and control lines in order to monitor conditions and operate the BOP stack. It will be appreciated that similar to the drill string and drilling riser, the umbilical and control lines must traverse the distance between the offshore platform and the subsea wellhead.

The riser, umbilicals, control lines and other subsea elements, including buoyancy elements, are subjected to ocean currents along their respective lengths, causing lateral deflection in the riser from the seabed to the surface platform. A riser and control lines may be subjected to varying and differential ocean currents along its length resulting in complex lateral deflection of the riser and can result in a number of problems. Continued deflection of a riser may result in stress points along the length of the rise and ultimately weaken the riser. Radical lateral deflection in the riser could result in excessive drill string contact with the inner wall of the riser, resulting in further weakening of the riser.

Metaocean conditions, such as winter storms, hurricanes and typhoons add yet another element of complexity to offshore drilling operations. During such events, drilling operations are typically suspended and the crew is evacuated. In the case of fixed offshore platforms or compliant tower platforms, the riser is often left in place as it is supported by a conductor system that extends from near surface to near sea bed. Floating offshore platforms present different problems in that there are no conductors to support the riser system, which depends instead, on a combination of flotation cells and topside tensioners for support. Should a metaocean condition occur, the crew is similarly evacuated, leaving the riser system subject to current stresses, as well as wind and wave stresses placed on the floating platform.

To prevent damage from occurring, the riser system is often disconnected from the sea floor BOP stack and tripped, together with the control lines, to the platform surface. After the condition abates, the riser system, as well as the umbilicals and control lines are then reconnected to the sea floor BOP stack and a series of time-consuming safety tests are performed before drilling can resume.

It will be appreciated that the time required to disconnect and subsequently reconnect the riser system results in significant loss of rig time, particularly in the case of offshore platforms. Reconnection typically includes running the riser and associated umbilicals down to the seafloor BOP stack, and these are typically reconnected utilizing ROVs. The reconnection process can take many hours, followed by days of testing. Thus, there exists a need for time- and cost-effective means of disconnecting and reconnecting drilling riser systems.

Also, using conventional subsea BOP equipment, critical rig time is required to run, set and retrieve the subsea BOP and its accessories. There is correlation between the depth of the water and the time involved. There is also an associated risk of down time simply due to the complexity of the equipment. In addition to the down time associated with conventional subsea BOP equipment, conventional subsea BOPs require use of a large-diameter riser, which in turn requires more storage space on the deck of the platform prior to installation of said riser. The large-diameter risers also require high riser-tensioning capacity and/or additional buoyancy elements.

Surface BOP stack (SBOP) technology has been available since the 1960s, and overcomes some of the problems described for subsea BOPS. The SBOP is placed on or slightly below the deck of an offshore drilling platform. The riser connecting the wellhead to the surface BOP must be a high pressure riser, capable of withstanding formation pressure from the well.

Discussed thus far have been problems associated with disconnecting and reconnecting risers to seabed wells before and after metaocean events, such as storms. Another circumstance during conventional construction of subsea wells in which risers usually must be replaced is between the well drilling step and the production step of well construction.

As described above, conventional subsea risers are usually tolerant only to low pressures, and are used during the drilling step to simply guide the drill string to the sea floor. The low pressure riser may also contain the drilling mud and cuttings however, low pressure risers are inadequate for handling formation pressures of a production process.

After the target formations have been penetrated by the drill bit, production tubing is installed and one or two high pressure plugs are installed into the production tubing to secure the integrity of the well prior to removal of the subsea BOP stack. The subsea BOP stack is then retrieved to the surface wherein retrieval may have a duration of several days depending on the depth of water. Generally at this stage in the process, a production Christmas (Xmas) tree is lowered from the surface to the wellhead. A typical Xmas tree is an apparatus that provides multiple tubular elements used to control the flow of hydrocarbons to the surface and the pressures of the well annulus. A Xmas tree is also used for taking samples, and for guiding electrical cables for pumps or other devices. The installation of the Xmas tree requires disconnection of the drilling riser from the wellhead in order to attach the well head to the Xmas tree so that the subsequent production process may begin.

Clearly, the use of conventional low pressure drilling risers and subsea BOP stacks requires substantial amounts of time to switch between drilling equipment and production equipment. A significant amount of storage space and weight bearing capacity on the floating platform is also required in order to store the low pressure drilling risers and the production risers, the typically large and heavy subsea BOP stacks, and the greater quantities of drilling mud needed to fill the larger diameter low pressure drilling risers. As wells are being drilled in deeper waters, greater lengths of risers and greater quantities of mud must be used and stored on a floating platform, such as a Mobile Offshore Drilling Unit (MODU). The solution has been to build larger MODUs which are more expensive to build and to hire.

The conventional use of surface BOP stacks from a floating drilling unit also requires that the drilling riser be disconnected after a well has been completed in order to connect a production Xmas tree between the high pressure riser and the wellhead in order for prepare for the production process.

In spite of the above advancements in the art, time efficient systems and methods for drilling and completion of wells in marine environments have not been described.

Thus, there is a need in the art for systems and methods for time efficient drilling and completion of wells in marine environments, which do not suffer from the disadvantages of the prior art systems and methods.

There is another need for systems and methods that will allow a subsea well to be drilled and completed without the necessity of disconnecting the high pressure riser and inserting a production Xmas tree between the riser and the wellhead prior to production.

There is even another need for systems and methods that enable deepwater drilling with MODUs that provide smaller storage space and lighter load-bearing limits than are commonly required with conventional drilling systems and methods.

These and other needs in the art will become apparent to those of skill in the art upon review of this specification, including its drawings and claims.

SUMMARY OF THE INVENTION

It is an object of the present invention to provide systems and methods for drilling and completion of wells in marine environments in a time efficient manner, wherein the systems and methods do not suffer from the disadvantages of the prior art.

It is another object of the present invention to provide for systems and methods for producing a subsea well, wherein the systems and methods do not require disconnecting the high pressure riser and inserting an production Xmas tree between the riser and the wellhead before production can begin.

It is even another object of the present invention to provide for systems and methods for deepwater drilling with mobile offshore drilling units (MODU) that provide smaller storage areas and lighter load-bearing limits than are commonly required with conventional drilling systems and methods.

These and other objects of the present invention will become apparent to those of skill in the art upon review of this specification, including its drawings and claims.

According to one embodiment of the present invention, there is provided a system for drilling and producing from subsea wells wherein the systems includes a surface blowout preventer (BOP) stack and a drill-thru Xmas tree. Generally, the BOP stack is maintained and controlled at a position above sea level, and is connected to the drill-thru Xmas tree.

According to another embodiment of the present invention, there is provided a method for drilling a subsea well, wherein the method includes controlling well blowout with a well blowout preventer stack positioned above sea level. The method also includes drilling a well using a riser that functions for drilling the well, or carrying product from the well, or both. The method further includes drilling the well using a drill-thru Xmas tree, wherein the tree is utilized in both drilling and production processes.

DETAILED DESCRIPTION OF THE INVENTION

Figure 1:
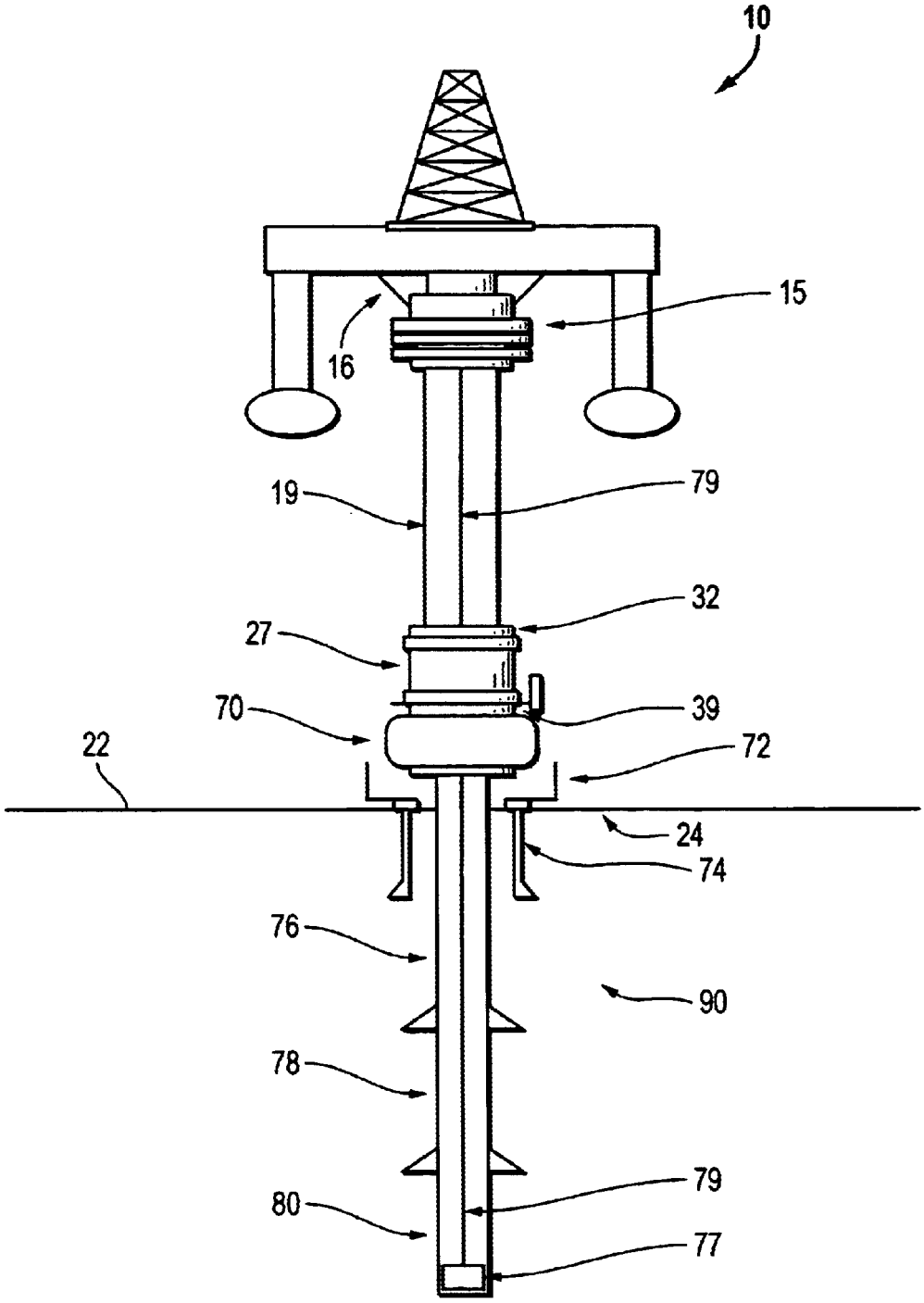
FIG. 1 illustrates a system of the present invention comprising a surface BOP, high pressure riser, SSODD, and drill thru Xmas tree.

The present invention is directed to novel systems and methods for construction and production of subsea wells in a time and labor efficient manner. The systems and methods of the present invention comprise a surface blowout protector stack (SBOP), a high pressure (HP) riser, and a drill thru Xmas tree. The systems and methods of the invention may further comprise a subsea shut off and disconnect device (SSODD).

The time- and labor-involved processes of suspending a well and removing drilling equipment prior to production from the well required with conventional systems and methods, have been overcome by the present invention. The methods and systems of the present invention comprise a riser systems which is used in both the well drilling process and the well production process. Thus, the present invention eliminates the tasks associated with conventional well constructing methods and systems comprising pulling the BOP and riser, and installing a production riser and Xmas tree. The present invention provides an efficient use of time and labor by using a drill thru Xmas tree as part of a high pressure riser system used in both the well drilling and well production procedures. The drill-thru Xmas tree is incorporated into the riser system by connecting the tree to the upper end of the surface casing which lines the upper portion of the wellbore. This connection may be made prior to the casing being lowered down into the subsea wellhead.

The high pressure risers used in conjunction with the SBOP in the present invention are light-weight risers which have smaller interior volumes and require less drilling mud than conventional systems and methods. Thus, the present invention enables deepwater drilling with a third-generation MODU due to the decreased riser deck size and in-place load requirements. In addition, the use of a surface BOP in the systems and methods of the present invention results in more time efficient drilling because the need to run a subsea BOP stack to the seabed is eliminated. These and other advantages of the systems and methods of the present invention are further discussed below.

With respect to surface BOP and high pressure risers, any surface BOP and high pressure risers known in the art are suitable for use herein. Selection of a surface BOP is dependent largely upon its measurements which must be compatible with the diameter of the high pressure riser selected for use. The high pressure riser selected for use must be capable of withstanding formation pressure from the wellhead.

It is preferred that the risers of the systems and methods of the present invention do not comprise control lines, in contrast to conventional full subsea blow out preventer stack systems. It will be appreciated that by eliminating control lines, the cost of the riser joint is reduced, and the need to test the integrity of the control lines is eliminated, thus saving time. The risers of the present invention may include various telescoping or flexure connections and may be supported by any of the buoyancy elements known in the art, together with a tensioner system.

With respect to drill thru Xmas trees, any such tree known in the art is suitable for use herein, so long as the drilling bore of the tree is of appropriate size to connect to the selected high pressure riser. The "thru" bore of the tree must also be capable of flexibly sealing with surfaces of the tubing hanger to be installed in the bore. It is also preferred that the Xmas tree comprise a bore protector for the sealing area faces.

With respect to SSOD, any SSODD known in the art is suitable for use herein. The SSODD preferred herein comprises a minimal BOP stack comprising at least one ram-type BOP, and even more preferably comprising at least one shear ram-type BOP. It is preferred that the SSODD be monitored and controlled by a system located on the platform. Generally the SSODD is controlled by acoustic signals for opening and closing of the minimal BOP stack of the SSODD, and those signals also control the disconnecting/reconnecting of the riser from the SSODD. Thus, in the event of a metaocean condition, the SSODD is able to close the wellhead and disconnect the riser without the use of control lines. A particularly preferred SSODD is described in U.S. Provisional Patent Application Serial No. 60/287,358, filed Apr. 30, 2001, entitled "Subsea Drilling Riser Disconnect System and Method", incorporated herein by reference.

Although generally not the case, it is within the scope of the invention that the systems and methods herein comprise use of a conventional subsea blowout preventer stack.

Generally the methods of the present invention provide a process for drilling a subsea well after a platform, such as an MODU, has been positioned above a target geological formation. The drilling process comprises passing a drill string down through a high pressure riser and through a drill thru Xmas tree, wherein the riser and the tree are used in both the processes of both drilling the well and production of product from the well. The methods also comprise controlling potential well blowouts with a blowout preventer such as a surface BOP. If there is a reasonable probability that the platform may be moved and disconnected from the wellhead due to a serious storm, leakage and blowout from the wellhead may be prevented by use of a minimal subsea blowout preventer, at the wellhead.

A first step in drilling of the wellbore of interest is to place a permanent guide base and a conductor at the wellhead A naked drill string may then be extended through the conductor and the drilling of the wellbore commences. After an initial wellbore is drilled, a surface casing may be installed in position to line the upper portion of the wellbore. The methods of the present invention may comprise attaching the drill thru tree to the upper end of the surface casing prior to lowering the casing into the wellbore. The drill thru tree is then also attached to the wellhead and is on position at about the level of the surface of the seabed.

Generally, the individual sections of the high pressure riser are assembled together to create a riser string, and the upper end of the riser string is connected to the SBOP, and the lower end of the riser string is connected to the emergency disconnect mechanism, which is in turn connected to a SSODD. The lower end of the riser string is then extended down from the platform and the SSODD is connected to the drill thru tree, generally via a permanent disconnect mechanism. Alternatively, the SSODD may be installed on top of the drill thru tree prior to the riser string being lowered. This type of separate installation of a SSODD may comprise ROVs, the uses of which are known in the art.

Once a continuous connection between the SBOP and the wellhead is established, a drill string is extended from the platform, through the high pressure riser, down through the drill thru tree and the surface casing, and into the wellbore. Drilling of the wellbore then continues in order to drill/reach the targeted formation containing desired product.

Once the producing formation of interest is penetrated to a position satisfactory for initiating production, a production liner is inserted through the drill-thru tree in order to line the deeper portions of the wellbore, and the drill string is returned to the platform. In contrast to conventional methods of constructing a subsea well which require replacing the drilling riser with a completion/production riser, then subsequently installing a non-drill thru Xmas tree onto the completion tubing, the well constructed by the present invention is immediately ready for testing, cleaning and installation of the completion tubing.

The process of well production subsequent to the drilling process generally comprises withdrawal of the drill string after the targeted formation has been sufficiently penetrated. The well product and water are then flowed up to the platform through the continuous connection in order to clean out the well. The desired well product then flows from the wellbore to the platform for storage and transport.

Referring now to FIG. 1, there is illustrated a preferred system of the present invention. Platform 10 is shown at the surface, with SBOP 15 supported by tensioner system 16. It will be appreciated that tensioner system 16 may be of any type generally known in the art. Floating platform 10 and SBOP 15 connect to high pressure (HP) riser 19 which extends down to emergency release mechanism 32. Emergency release mechanism 32 is connected to SSODD 27, which is connected to permanent disconnect mechanism 39, which is connected to drill-thru Xmas tree 70. One of the many advantages of the present invention is the ability to transport tree 70 down to wellhead 24 via surface casing 76. Drill bit 77 attached to drill string 79 is extended from platform 10 through the assembly described above and through weilbore 90, surface casing 76, and liners 78 and 80, in order to complete drilling to the targeted formation (not shown).

The system illustrated by FIG. 1 is shown at the step of a completed well wherein production liner 80 is inserted through permanent guide base 72 located on the surface of seabed 22 through conductor 74. Conductor 74 serves as a guide for drilling below guide base 72, down through surface casing 76 and drilling liner 78. Casing, liners and other tubing are held by a tubing hanger system (not shown). Any tubing hanger system known in the art is suitable for use herein so long as the maximum outside diameter of the tubing hanger is compatible with the inside diameter (ID) of the high pressure riser 19 connecting SBOP 15 with drill thru Xmas tree 70. For example, in the case of a 13⅜" riser, the inside diameter is 12¼", and in the case of a 14" riser the inside diameter is 12½".

The assembly of elements shown in FIG. 1 is achieved by connecting individual riser joints to produce HP riser 19, and extending HP riser 19 vertically/down through SBOP 15 from platform 10 to disconnect 32. Disconnect 32 is then connected to SSODD 27, which is then connected to disconnect 39, which in turn is connected to drill thru tree 70. An alternative method of assembly is to attach disconnects 32 and 39 and SSODD 27 in the order described above to the lower end of riser 19 before riser 19 is lowered to drill thru tree 70.

Initiation of drilling generally involves placement of permanent guide base 72 and conductor 74. A naked (i.e., not housed within a riser) drill string reaching from platform 10 to wellhead 24 drills into seabed 22, ideally to a point near, but not into, a target formation. As the drilling proceeds, surface casing 76, the top end of which is connected to drill thru Xmas tree 70, is inserted through conductor 74. Surface casing 76 is then suspended by a casing hanger (not shown) from wellhead 24 which is then connected to tree 70.

One subsea well system of the present invention generally comprises an offshore platform located at sea level and positioned generally above a target formation of interest, a blowout preventer stack connected to the platform. Preferably the stack is positioned above sea level and controlled from above sea level. The system also comprises a high pressure riser which extends from the platform down toward a subsea wellbore which penetrates a portion of the seabed above the target formation. Preferably the riser has a first end located above sea level connected to the blowout preventer stack, and a second end located near the seabed and positioned above the wellhead of said wellbore. A unique feature of the present system is that the riser is utilized in the process of drilling through the wellbore into the formation and also in the process of producing product from the formation. The system also comprises a drill-thru Xmas tree positioned at the wellhead. Preferably the drill-thru Xmas tree is connected to the end of riser positioned close to the seabed. If the system comprises a surface casing lining the interior of the wellbore, the lower end of the Xmas is connected to the lining. The system may further comprise a subsea shut off and disconnector device positioned between said tree and riser. During the process of drilling, the system may even further comprise a drill string extending from the platform down toward the target formation. Preferably the drill string is internally received by the riser, and a riser annulus is created between the riser and the string.

The present invention is also directed to a method for drilling a subsea well, the method comprising the steps of drilling a wellbore from a wellhead toward a formation of interest with a drill bit attached to a drill string, and controlling pressure of the wellbore by use of a well blowout preventer stack positioned above sea level and connected to said offshore platform. Preferably the drill string is internally received by a high pressure riser having a first end coupled to an offshore platform and a second end coupled to a drill thru Xmas tree coupled to the wellhead of said wellbore. The method further comprises the step of controlling well blowout with a subsea shut off and disconnect device. In a preferred embodiment, the drilling step comprises penetrating the formation of interest. The method may further comprise the steps of retrieving the drill string to the platform, and obtaining product from the formation by use of said Xmas tree and said riser. Again, because the present invention comprises a drill-thru xmas tree and a high pressure riser, there is not a need to pull the riser after the drilling process in order to proceed with well production.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. A subsea well system comprising:

(a) an offshore platform located at sea level, said platform positioned generally above a target formation of interest;

(b) a blowout preventer stack connected to said platform, wherein said stack is positioned above sea level and controlled from above sea level;

(c) a high pressure riser extending from said platform down toward a subsea wellbore penetrating a portion of the seabed above said target formation, wherein said riser has a first end located above sea level connected to said blowout preventer stack, and a second end located near the seabed and positioned above the wellhead of said wellbore, and wherein said riser is utilized in drilling though the wellbore into said formation and in producing product from said formation;

(d) a drill-thru Xmas tree positioned at the wellhead, wherein said drill-thru Xmas tree comprises an upper end and a lower end, and wherein said upper is connected to said second end of said riser;

(e) a drill string extending from said platform down toward said formation, wherein said drill string is internally received by said riser, and wherein a riser annulus is created between said riser and said string.

2. The system of claim 1 further comprising:

(f) a subsea shut off and disconnector device positioned between said tree and riser.

3. The system of claim 1, wherein said lower end of said Xmas tree is connected to a surface casing lining the interior of said wellbore.

4. A method for drilling a subsea well, the method comprising the steps of:

(a) drilling a wellbore from a wellhead toward a formation of interest with a drill bit attached to a drill string, wherein said drill string is internally received by a high pressure riser having a first end coupled to an offshore platform and a second end coupled to a drill thru Xmas tree coupled to the wellhead of said wellbore;

(b) controlling pressure of the wellbore by use of a well blowout preventer stack positioned above sea level and connected to said offshore platform;

(c) controlling well blowout with a subsea shut off and disconnect device.

5. The method of claim 4, wherein said drilling of step (a) comprises penetrating the formation of interest.

6. The method of claim 5 further comprising the steps of:

(c) retrieving the drill string to the platform; and (d) obtaining product from said formation by use of said Xmas tree and said riser.

* * * * *